US007766027B2

(12) United States Patent
Davidson, Sr. et al.

(10) Patent No.: US 7,766,027 B2
(45) Date of Patent: Aug. 3, 2010

(54) VENTED STEAMER PORT CAP ASSEMBLY

(75) Inventors: Tom R. Davidson, Sr., Griffin, GA (US); Anthony Ferrari, McDonough, GA (US); Carlos Moreno, Hampton, GA (US)

(73) Assignee: Davidson Hydrant Technologies, Inc., Sunnyside, GA (US)

( * ) Notice: Subject to any disclaimer, the term of this patent is extended or adjusted under 35 U.S.C. 154(b) by 314 days.

(21) Appl. No.: 12/047,681

(22) Filed: Mar. 13, 2008

(65) Prior Publication Data

US 2009/0229679 A1 Sep. 17, 2009

(51) Int. Cl.
*E03B 9/02* (2006.01)

(52) U.S. Cl. ..... 137/15.18; 137/299; 137/296; 137/517; 137/535

(58) Field of Classification Search ..... 137/299, 137/296, 517, 535, 15.18, 300, 272
See application file for complete search history.

(56) References Cited

U.S. PATENT DOCUMENTS

| | | | | |
|---|---|---|---|---|
| 2,489,787 | A * | 11/1949 | Knowlton | 137/539 |
| 3,983,899 | A * | 10/1976 | Graham et al. | 137/495 |
| 6,868,860 | B2 | 3/2005 | Davidson | |
| 6,910,495 | B2 * | 6/2005 | Lafalce | 137/299 |
| 7,278,442 | B2 * | 10/2007 | Holland et al. | 137/296 |

* cited by examiner

*Primary Examiner*—Kevin L Lee
(74) *Attorney, Agent, or Firm*—Kilpatrick Stockton LLP

(57) ABSTRACT

The present invention relates generally to methods and devices for providing a fire hydrant with a vented steamer port cap assembly to allow air and water to pass through an upper area of a fire hydrant. Various embodiments include hydrants with a vented steamer port cap assembly. In other embodiments, a secondary valve is included in the barrel of the fire hydrant to controllably allow liquid to flow through the hydrant.

23 Claims, 9 Drawing Sheets

VENTED STEAMER PORT CAP ASSEMBLY

FIELD OF THE INVENTION

Various aspects and embodiments of the present invention relate generally to fire hydrants, and more particularly to port caps for fire hydrants configured to allow excess water to drain out of the hydrant.

BACKGROUND OF THE INVENTION

In general, fire hydrants offer access to a municipal water supply that may be used to control or extinguish fires. Briefly, such fire hydrants include at least one nozzle for coupling to a fire hose. A threaded cap closes off the nozzle when the hydrant is not in use. The hydrant also includes a primary hydrant valve which controls flow of water from the water supply through the hydrant, through the nozzle, and into the fire hose.

Generally, when a hydrant is used to provide water to extinguish fires, or otherwise, a nut on top of the fire hydrant is rotated in one direction to open the primary hydrant valve inside the fire hydrant barrel. Water flows through the hydrant and out the nozzle. When the need for the water no longer exists, the nut is rotated in a second direction closing the primary hydrant valve.

Water may remain in a fire hydrant cavity after the primary valve is closed. Some fire hydrants may provide a drain or drain hole at the base of the hydrant to allow water in the fire hydrant to drain to the exterior of the hydrant. Water must drain from the hydrant to prevent water, in colder climates, from freezing and damaging the hydrant. In some cases, the drain hole may become plugged, thus preventing water from effectively draining from the hydrant. Also, a vacuum may be created inside the barrel of the hydrant that prevents water from draining from the drain hole. Accordingly, a need exists to provide an alternative location to drain at least some of the excess water from the hydrant and/or to equalize the pressure within the hydrant with atmospheric pressure to allow water to effectively drain from the drain hole.

Typically, the barrel of the hydrant between the nozzle and the hydrant valve, which is in the lower portion of the hydrant, accommodates several gallons of fluids or solids. Accordingly, it is possible to unscrew a nozzle cap, introduce gallons of toxin, reattach the nozzle cap, and open the hydrant valve to allow the toxins to communicate with and flow by gravity and perhaps at least to some extent by Bernoulli's principle, into the municipal water supply, since when the nozzle cap is attached, water pressure from the water supply would not force the toxins back out of the hydrant.

An example of a system and method for preventing toxins from being introduced to a water supply through a hydrant is described in U.S. Pat. No. 6,868,860, entitled "Fire Hydrant With Second Valve." In some examples described in U.S. Pat. No. 6,868,860, a valve structure is introduced between the nozzle and the primary valve that makes it more difficult or impossible to introduce toxins into a water supply through a fire hydrant. The valve structure prevents or substantially prevents the flow of water through the hydrant upon certain conditions and closes off portions of the hydrant barrel when a nozzle is open but the hydrant valve is closed. Generally, the valve structure may include a seat, a restriction member, and a biasing structure.

Hydrants with a secondary valve not only prevent water and toxins from mixing, but also, in some instances, may prevent atmospheric conditions from the barrel above the secondary valve from reaching the area of the barrel below the secondary valve. Since air from the atmosphere does not reach the interior area of the hydrant below the secondary valve, water may not, in some circumstances, drain or weep through the drain hole. Therefore, a need exists for a mechanism that allows water or other liquid to drain out of a fire hydrant when the secondary valve is closed.

Under some conditions, the secondary valve may close when the water level in the hydrant is above the location of the secondary valve, thus trapping water in the upper portion of the hydrant. Under these conditions, the water in the upper portion of the hydrant cannot reach the drain hole located in the lower portion of the hydrant. Allowing water to remain trapped in the upper portion of the hydrant poses a risk of damaging the hydrant in colder climates where the water may freeze. Thus, a need exists for a mechanism that allows water or other liquid trapped above the secondary valve to drain out of a fire hydrant.

SUMMARY OF THE INVENTION

Accordingly, certain aspects and embodiments of the present invention provide a device to be included in a fire hydrant that allows water or other liquid to drain out a drain hole or provide an alternate path for at least some of the water or other liquid to leave the hydrant. In some embodiments, the device includes a vented steamer port cap assembly adapted to be coupled to a fire hydrant steamer port. In other embodiments, the vented steamer port cap assembly is coupled to a steamer port of a hydrant with a secondary valve that allows water or other liquid in the area of the barrel below the secondary valve to drain out the drain hole.

Certain embodiments of the vented steamer port cap assembly may include a steamer port cap with at least one cap aperture to allow air and/or water to enter and/or exit the hydrant. A gasket may be coupled to an interior surface of the steamer port cap. The gasket may include at least one gasket aperture adapted to substantially align with the cap aperture. A first end of a shaft may be coupled to an interior surface of the steamer port cap. A second end of the shaft may be associated with a check valve. A spring may surround the exterior surface of the shaft to separate the check valve from the gasket until a force is applied to the check valve, causing the check valve to move towards the gasket. Some embodiments may also include at least one pin that is attached to the check valve. The pin may extend through the gasket and cap apertures.

In some embodiments, the vented steamer port cap assembly may exert a normal pressure against the spring when the vented steamer port cap assembly is in a venting position. An example of normal pressure may include ten pounds per square inch (psi). The vented steamer port cap assembly may exert a compression pressure against the spring when the vented steamer port cap assembly is in a closed position. An example of compression pressure may include eighteen pounds per square inch (psi).

In some embodiments of the present invention, a fire hydrant is provided having a barrel with an inner cavity. The fire hydrant may also include a steamer port for providing access to the barrel interior. The fire hydrant may include a vented steamer port cap assembly adapted to be coupled to the steamer port. The fire hydrant may also contain a primary valve to controllably restrict communication between the barrel and a water conduit. In some embodiments, the fire hydrant may include a secondary valve for controllably allowing liquid to flow through the barrel.

According to one embodiment of the present invention, a method of retrofitting a fire hydrant with a vented steamer port cap assembly is provided. A hydrant is selected that includes a hydrant body. The hydrant may also include a steamer port and a steamer port cap coupled to the steamer port. The steamer port cap is then detached from the steamer port. A vented steamer port cap assembly is then provided. The steamer port cap assembly may include a steamer port cap with at least one aperture, a check valve substantially aligned with the one steamer port cap, and a spring adapted to controllably locate the check valve relative to the steamer port cap. The vented steamer port cap assembly may be located over the steamer port and tightened over the threaded portion of the steamer port. In some embodiments, the existing steamer port cap may require loosening from the threaded portion of the steamer port and detaching from a securing device.

DETAILED DESCRIPTION

Certain aspects and embodiments of the present invention provide a vented steamer port cap assembly adapted to be coupled to a steamer port on a fire hydrant. The fire hydrant may include a barrel having at least one nozzle and a steamer port adapted to allow access to an interior of the hydrant. The fire hydrant may also include a nozzle cap over the nozzle. The fire hydrant may also include a primary hydrant valve to controllably provide access to a water source.

In some embodiments, the vented steamer port cap assembly may allow air and/or water to enter and/or exit through a vented steamer port cap. Pressure inside the barrel may be equalized with the outside atmospheric pressure due to air passing through the steamer port cap. The vented steamer port cap assembly may also function as an additional drain to remove at least some water from the barrel of the fire hydrant. In some embodiments, the vented steamer port cap assembly is adapted to close when the primary valve is opened.

Illustrative Example of Fire Hydrant and a Vented Steamer Port Cap Assembly

Figure 1:
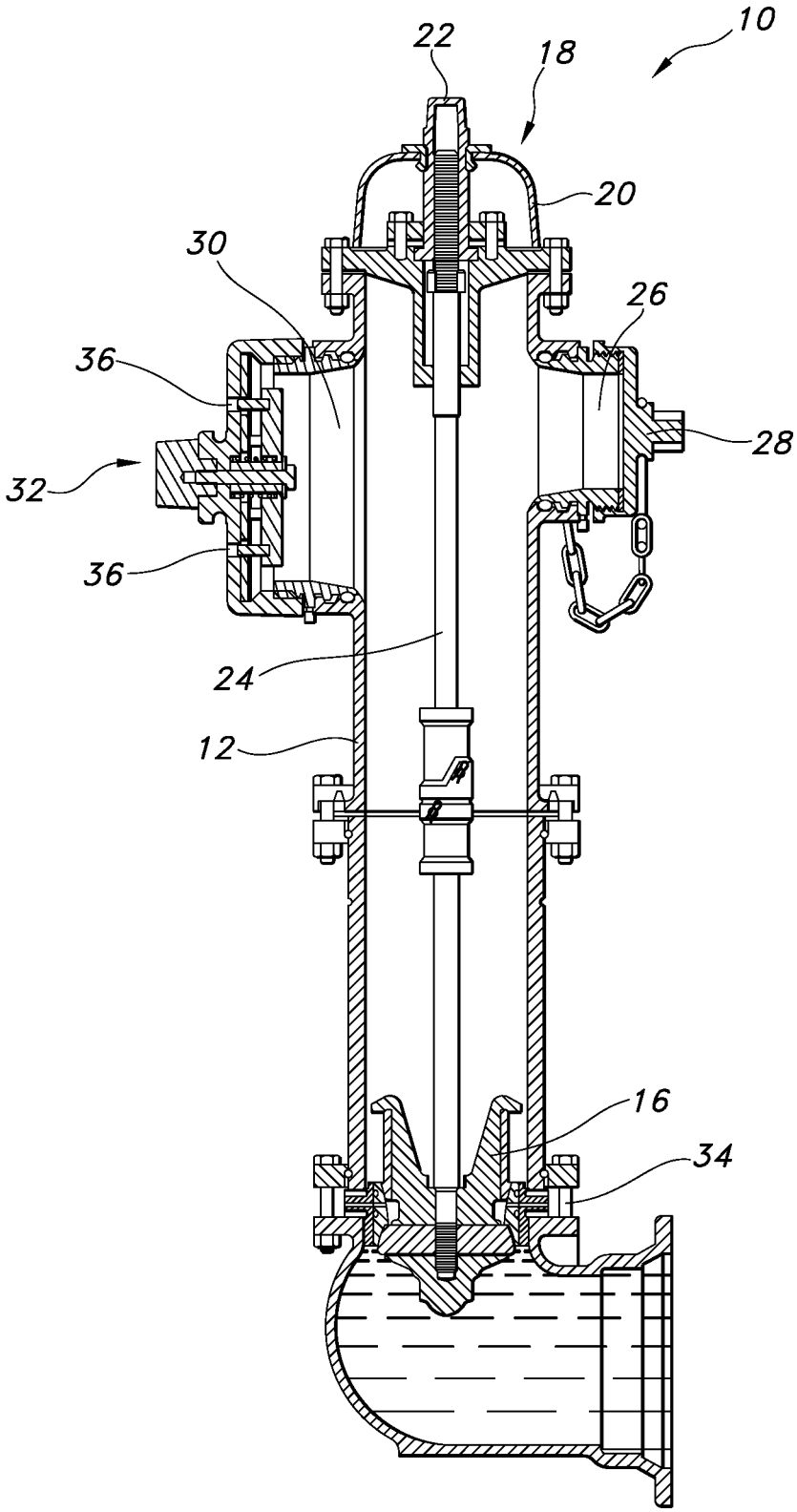
FIG. 1 shows a cross-sectional view of a fire hydrant with a vented steamer port cap assembly in a venting position according to one embodiment of the present invention.

FIG. 1 shows one embodiment of a hydrant 10. Hydrant 10 includes a substantially vertical barrel 12. Water flows through barrel 12 from a water main 14 to a fire hose given certain circumstances as discussed generally below. A primary hydrant valve 16 is located at one end of barrel 12, which controllably interrupts fluid flow between water main 14 and barrel 12. At the upper end of barrel 12 is a cap structure 18 that may include, for instance, a housing cover 20 and an operating nut 22, which rotates within housing cover 20. Operating nut 22 includes threads that receive threads on an actuator rod 24, which in turn connects to primary hydrant valve 16. The cap structure 18 may seal the top portion of barrel 12 to prevent the flow of water and operating nut 22 may be used by fire fighters or others to open primary hydrant valve 16 via actuator rod 24. Hydrant 10 includes at least one nozzle 26. The at least one nozzle 26 may be closed with a cap, such as a threaded cap 28.

In some embodiments, hydrant 10 includes a steamer port 30, which typically includes a larger opening than nozzle 26 to provide access to an interior of the barrel 12. Steamer port 30 may provide access to a larger volume of water from the interior of the barrel 12 than nozzle 26. In some embodiments, steamer port 30 is located on barrel 12 adjacent to the at least one nozzle 26. Viewing hydrant 10 from above, steamer port 30 may be located in a range of 45 to 180 degrees relative to at least one nozzle 26. An upper edge of steamer port 30 may be located at substantially the same height as the upper edge of nozzle 26 relative to the location of primary hydrant valve 16. In other embodiments, the center point of steamer port 30 may be located at substantially the same height as the center point of nozzle 26 relative to the location of primary hydrant valve 16. In some embodiments, steamer port 30 is closed with a vented steamer port cap assembly 32. When installed in hydrant 10, vented steamer port cap assembly 32 may allow air to flow between the interior of hydrant 10 and the outside atmosphere.

In some embodiments, hydrant 10 includes a drain hole 34 located at the bottom of barrel 12 adjacent to primary hydrant valve 16. Drain hole 34 removes water or other fluids trapped inside barrel 12 after primary hydrant valve 16 closes. Under some conditions, fluids may be unable to exit barrel 12 through drain hole 34. For example, drain hole 34 may become substantially plugged with debris. In other situations, drain hole 34 may be open, but a vacuum is created within barrel 12 that prevents fluids from draining through drain hole 34.

At least one cap aperture 36 located on vented steamer port cap assembly 32 may allow water to drain out of the hydrant 10 when drain hole 34 is unable to remove water from barrel 12. In some embodiments, the at least one cap aperture 36 may allow air and/or water to enter and/or exit hydrant interior and facilitate water drain through drain hole 34. To allow both air and/or water to enter and/or exit cap aperture 36, vented steamer port cap assembly 32 may be positioned in a venting position. Vented steamer port cap assembly 32 may remain in the venting position until primary hydrant valve 16 is opened. Once opened, pressure from water traveling through the hydrant interior may force vented steamer port cap assembly 32 into a closed position.

Illustrative Example of a Vented Steamer Port Cap Assembly

Figure 2:
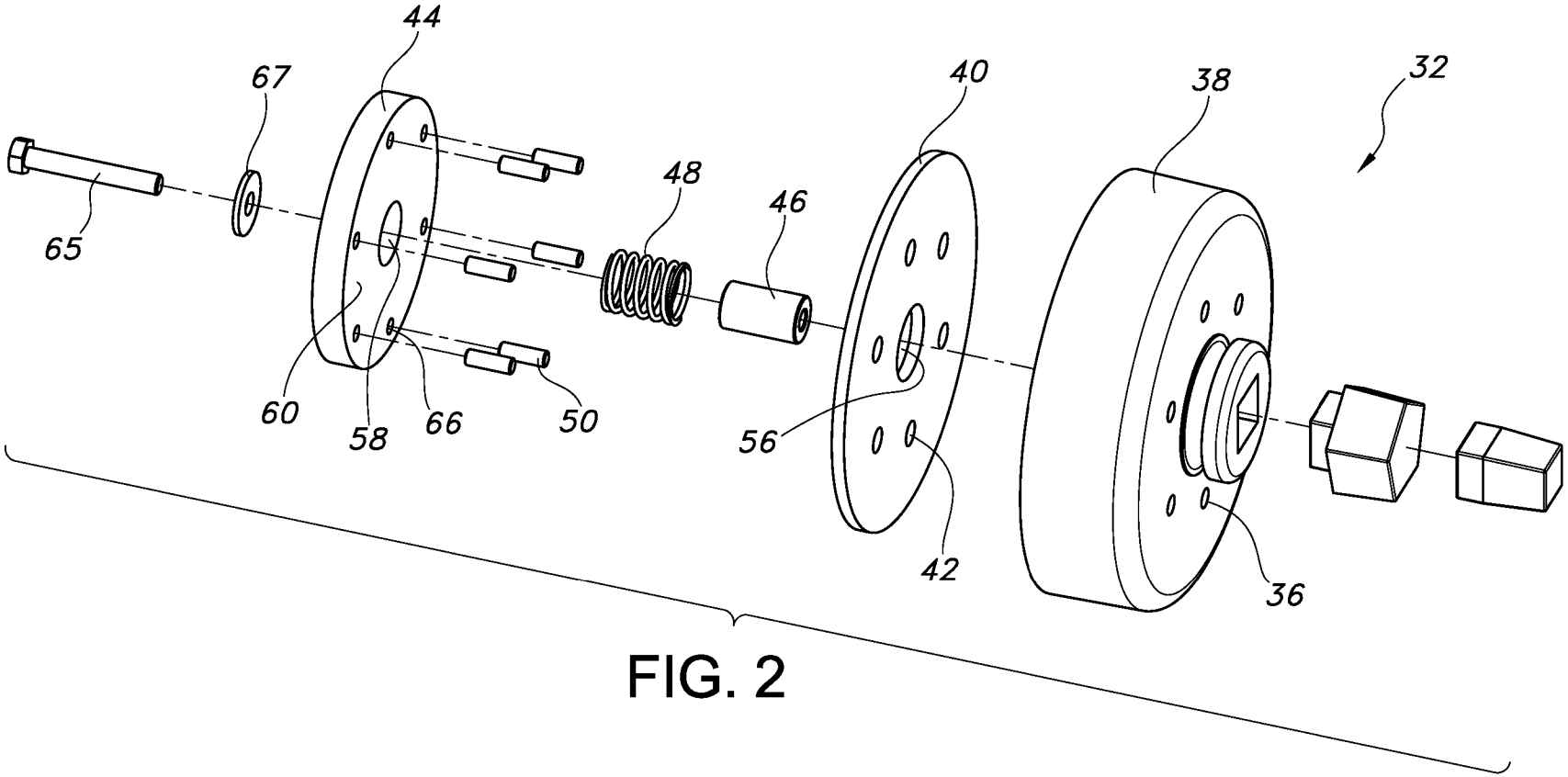
FIG. 2 shows an exploded view of a vented steamer port cap assembly according to one embodiment of the present invention.
Figure 3:
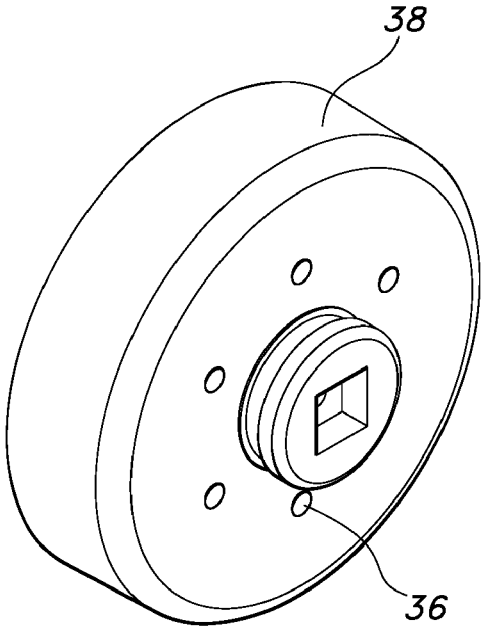
FIG. 3 shows a perspective view of an external side of a steamer port cap assembly according to one embodiment of the present invention.

FIG. 2 shows an exploded view of a vented steamer port cap assembly 32 according to one embodiment of the present invention. Vented steamer port cap assembly 32 includes a steamer port cap 38. Steamer port cap 38 includes at least one cap aperture 36 that may allow air and/or water to enter and/or exit a hydrant interior when water from a water supply is not traveling through the hydrant interior. A gasket 40 may be located adjacent to the interior surface of steamer port cap 38. Gasket 40 includes at least one gasket aperture 42 that substantially aligns with cap aperture 36. A check valve 44 is coupled to gasket 40 and steamer port cap 38 by a shaft 46. When hydrant 10 is not in operation, check valve 44 may be spaced apart from gasket 40 by a spring 48 that surrounds shaft 46 to allow air and/or water to enter and/or exit the hydrant interior. When water or other fluid travels through the hydrant interior, pressure may be applied to check valve 44 causing the spring 48 to compress against gasket 40 and locate check valve 44 substantially adjacent to gasket 40 to close the at least one cap aperture 36. When check valve 44 is substantially adjacent to gasket 40, cap aperture 36 may be sealed to prevent air and/or water from entering or exiting the hydrant interior.

Vented steamer port cap assembly 32 includes steamer port cap 38. Perspective, exterior, side, and interior views of steamer port cap 38 are shown in FIGS. 3-6, respectively. Materials used to form steamer port cap 38 may include cast iron or other similar material. In other embodiments, steamer port cap 38 may be constructed from a metal providing a substantially smooth interior surface or coated with a material providing a substantially smooth interior surface. In some embodiments, check valve 44 may be located in direct contact with the interior surface of steamer port cap 38 without the use of gasket 40 when pressure is applied to check valve 44.

In some embodiments, at least one cap aperture 36 creates an opening in steamer port cap 38 to allow air and/or water to enter and/or exit barrel 12. The steamer port cap assembly 32 may include any number of cap apertures 36. In other embodiments, steamer port cap 38 includes six cap apertures 36.

According to some embodiments of the present invention, gasket aperture 42 and cap aperture 36 are sized to allow a pin 50 to extend through both gasket aperture 42 and cap aperture 36. Pin 50 may be sized to allow air and/or water to enter and/or exit through the gasket aperture 42 and cap aperture 36. In other embodiments, gasket aperture 42 and cap aperture 36 may be sized to snugly fit against pin 50 when the vented steamer port cap assembly 32 is in a closed position. The pin 50 may be located outside of the gasket aperture 42 and cap aperture 36 when vented steamer port cap assembly 32 is in a venting position.

Figure 4:
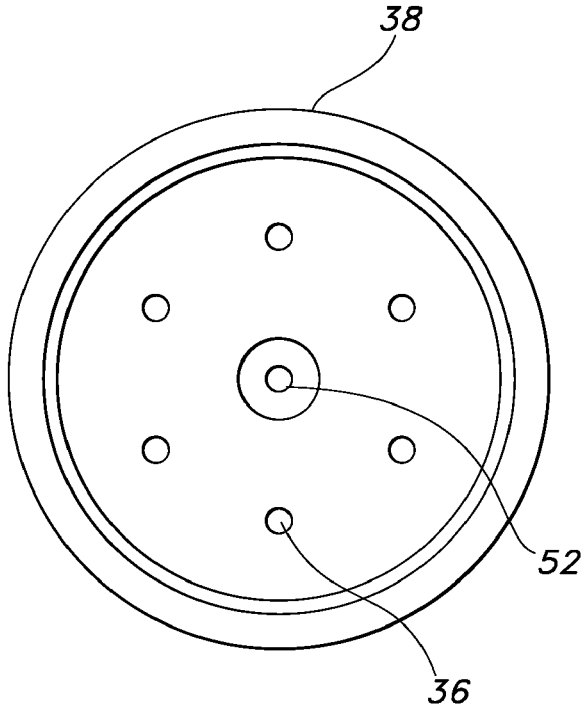
FIG. 4 shows a front view of an interior of a steamer port cap assembly according to one embodiment of the present invention.

As shown in FIG. 4, an indentation 52 may be located in the center of the interior surface of steamer port cap 38. In some embodiments, indentation 52 is sized to receive shaft 46 and spring 48. In other embodiments, indentation 52 may be sized to receive shaft 46. One end of spring 48 may contact the interior surface of steamer port cap 38 adjacent to indentation 52.

Figure 5:
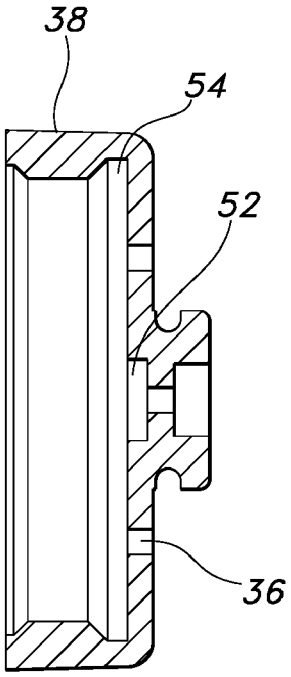
FIG. 5 shows a side view of a steamer port cap assembly according to one embodiment of the present invention.
Figure 6:
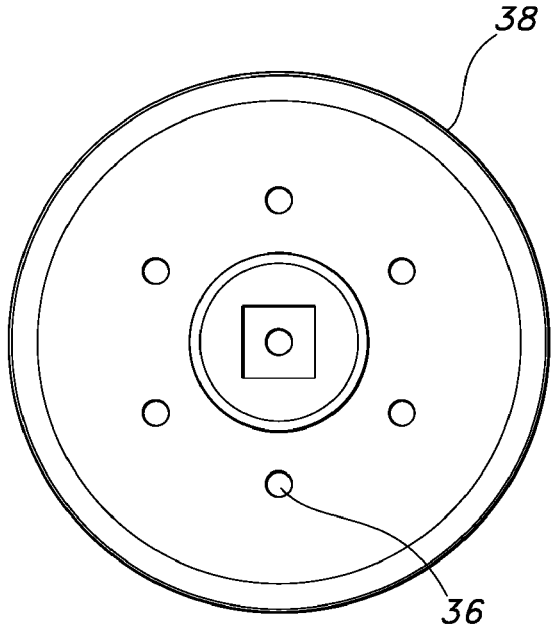
FIG. 6 shows a front view of an exterior of a steamer port cap assembly according to one embodiment of the present invention.
Figure 7:
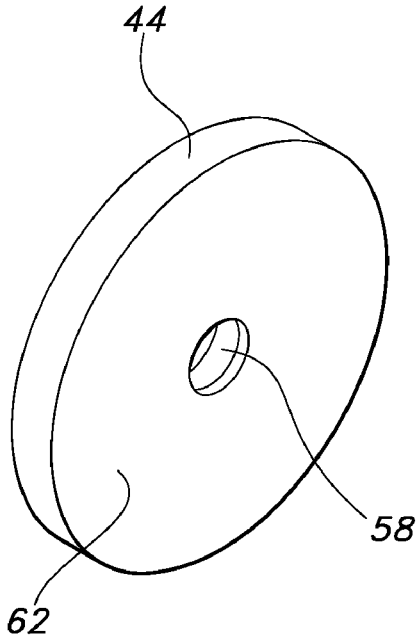
FIG. 7 shows a perspective view of an exterior of a check valve according to one embodiment of the present invention.

As shown in FIG. 5, steamer port cap 38 may also include a niche 54 to support gasket 40. According to some embodiments of the present invention, niche 54 is sized to fit the outer diameter and thickness of gasket 40 to secure gasket 40 against the interior surface of steamer port cap 38. In other embodiments, gasket 40 is secured to the interior surface of steamer port cap 38 by glue or other fastening devices or methods. In some embodiments, the gasket 40 is secured to the interior surface of steamer port cap 38 using fastening devices or methods without using niche 54.

According to some embodiments, gasket 40 may be coupled to the interior surface of steamer port cap 38. Gasket 40 may be press-fit into niche 54, adjacent to the interior surface of steamer port cap 38. In other embodiments, gasket 40 may be glued or otherwise secured to the interior surface of steamer port cap 38. Materials used to form gasket 40 may include rubber EPDM or other similar material.

Gasket 40 may include a center gasket aperture 56, which substantially aligns with indentation 52. In some embodiments, gasket 40 also includes at least one gasket aperture 42, which substantially aligns with at least one cap aperture 36. The at least one gasket aperture 42 may include any number of apertures. For example, gasket 40 may include six gasket apertures 42. In some embodiments of the present invention, the vented steamer port cap assembly 32 may not include gasket 40 and the check valve 44 may be placed in direct contact with the interior surface of steamer port cap 38.

According to some embodiments of the present invention, check valve 44 is coupled to gasket 40 and steamer port cap 38 by shaft 46. Perspective, exterior, side, and interior views of check valve 44 are shown in FIGS. 7-10, respectively. Materials used to form check valve 44 may include plastic or other similar material. When vented steamer port cap assembly 32 is in the closed position, check valve 44 may contact gasket 40 to prevent water and air from entering or exiting the hydrant interior through cap aperture 36. In other embodiments, check valve 44 may directly contact the interior surface of steamer port cap 38.

Figure 8:
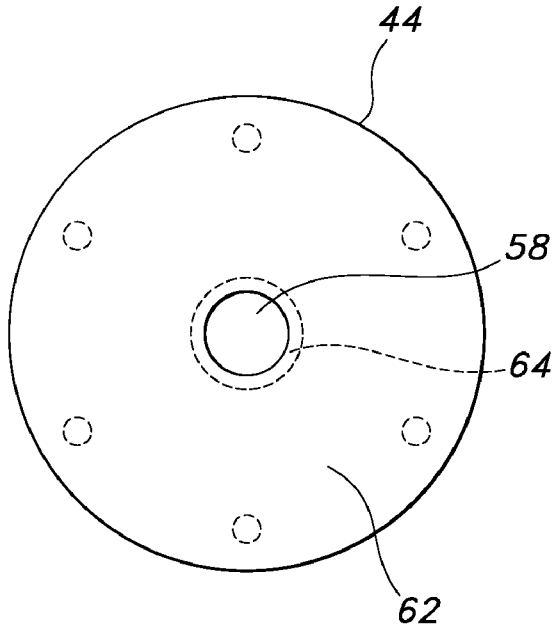
FIG. 8 shows a front view of an exterior of a check valve according to one embodiment of the present invention.
Figure 9:
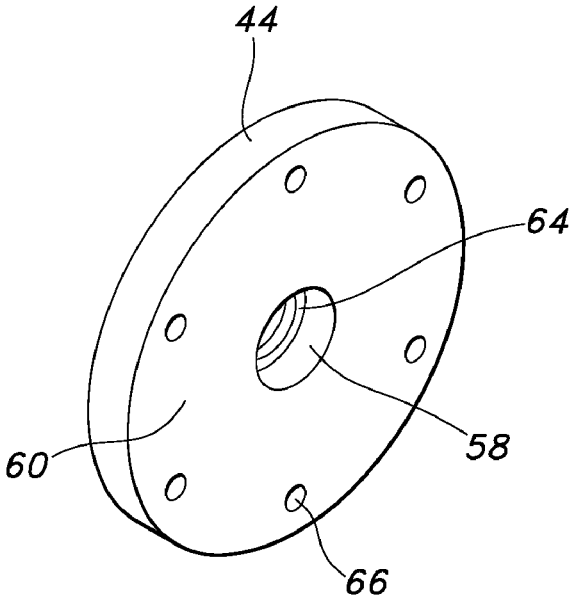
FIG. 9 shows a perspective view of an interior of a check valve according to one embodiment of the present invention.
Figure 10:
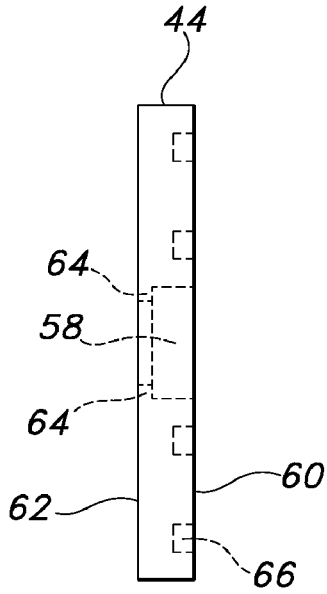
FIG. 10 shows a side view of a check valve according to one embodiment of the present invention.

In some embodiments, check valve 44 includes a check valve aperture 58. The diameter of check valve aperture 58 may be larger on an interior surface 60 of check valve 44 than on an exterior surface 62 of check valve 44. As shown in FIGS. 8-10, a lip 64 may surround check valve aperture 58 on exterior surface 62. Lip 64 may create a difference in diameters of check valve aperture 58. Lip 64 may contact an end of spring 48, which prevents spring 48 from extending through exterior surface 62.

In some embodiments, check valve 44 may include a washer or other retaining device to prevent spring 48 from extending through external surface 62. Additionally or alternatively, the check valve aperture 58 may be sized to prevent spring 48 from penetrating check valve 44. The interior surface 60 may contact one end of spring 48.

According to some embodiments of the present invention, check valve 44 may be coupled to shaft 46 by a screw 65 and a washer 67. Screw 65 is located within a center aperture on washer 67. The screw and washer combination may extend through the center of shaft 46 and couple to steamer port cap 38. Washer 67 may be located adjacent to lip 64. The coupling of screw 65 to steamer port cap 38 may cause washer 67 to exert a normal pressure on check valve 44, which in turns acts to partially compress spring 48 in the venting position. An example of normal pressure may include ten pounds per square inch (psi).

In some embodiments, check valve 44 includes at least one rounded pin indentation 66 that substantially aligns with gasket aperture 42 and cap aperture 36. The at least one rounded pin indentation 66 may include any number of pin indentations, an example of which is six pin indentations. Pin indentation 66 may couple to pin 50. In other embodiments, pin indentation 66 may couple to another object shaped to project outwardly through gasket aperture 42 and cap aperture 36.

In some embodiments, shaft 46 extends through center gasket aperture 56 so that one end of shaft 46 contacts indentation 52. An opposing end of shaft 46 may be located through check valve aperture 58. Materials used to form shaft 46 may include 304 stainless steel or other similar material.

According to some embodiments of the present invention, spring 48 is located adjacent to shaft 46 to allow an interior surface of spring 48 and the exterior surface of shaft 46 to substantially contact each other. Materials used to form spring 48 may include 302 stainless steel or other similar material.

One end of spring 48 may contact indentation 52 adjacent to shaft 46. In some embodiments, spring 48 may contact the interior surface of steamer port cap 38 adjacent to indentation 52.

An opposing end of spring 48 may be located through a portion of check valve aperture 58 and prevented from extending through check valve aperture 58 by lip 64. In some embodiments, a washer or other retaining device may prevent spring 48 from extending through check valve aperture 58. Alternatively or additionally, check valve aperture 58 may be sized to prevent spring 48 from penetrating check valve 44. The interior surface 60 may contact one end of spring 48.

One end of at least one pin 50 may be coupled to at least one pin indentation 66. In some embodiments, six pins 50 are coupled to six pin indentations 66. Materials used to form pin 50 may include 304 stainless steel or other similar material.

Pin 50 may be located through gasket aperture 42 and cap aperture 36. Pin 50 may be adapted to prevent debris from blocking gasket aperture 42 and cap aperture 36. Pin 50 may move relative to steamer port cap 38 based on the position of check valve 44.

According to some embodiments of the present invention, pin 50 is sized to pass through gasket aperture 42 and cap aperture 36 without contact. By maintaining a small space between pin 50 and both gasket aperture 42 and cap aperture 36, air and/or water may enter and/or exit the hydrant interior through cap aperture 36 while pin 50 is extended through the openings. In some embodiments, pin 50 may be sized to fit snugly against gasket aperture 42 and cap aperture 36. The pin 50 may fully retract from gasket aperture 42 and cap aperture 36 when vented steamer port cap assembly 32 is in the venting position.

Illustrative Vented Steamer Port Cap Assembly Operation

Figure 11:
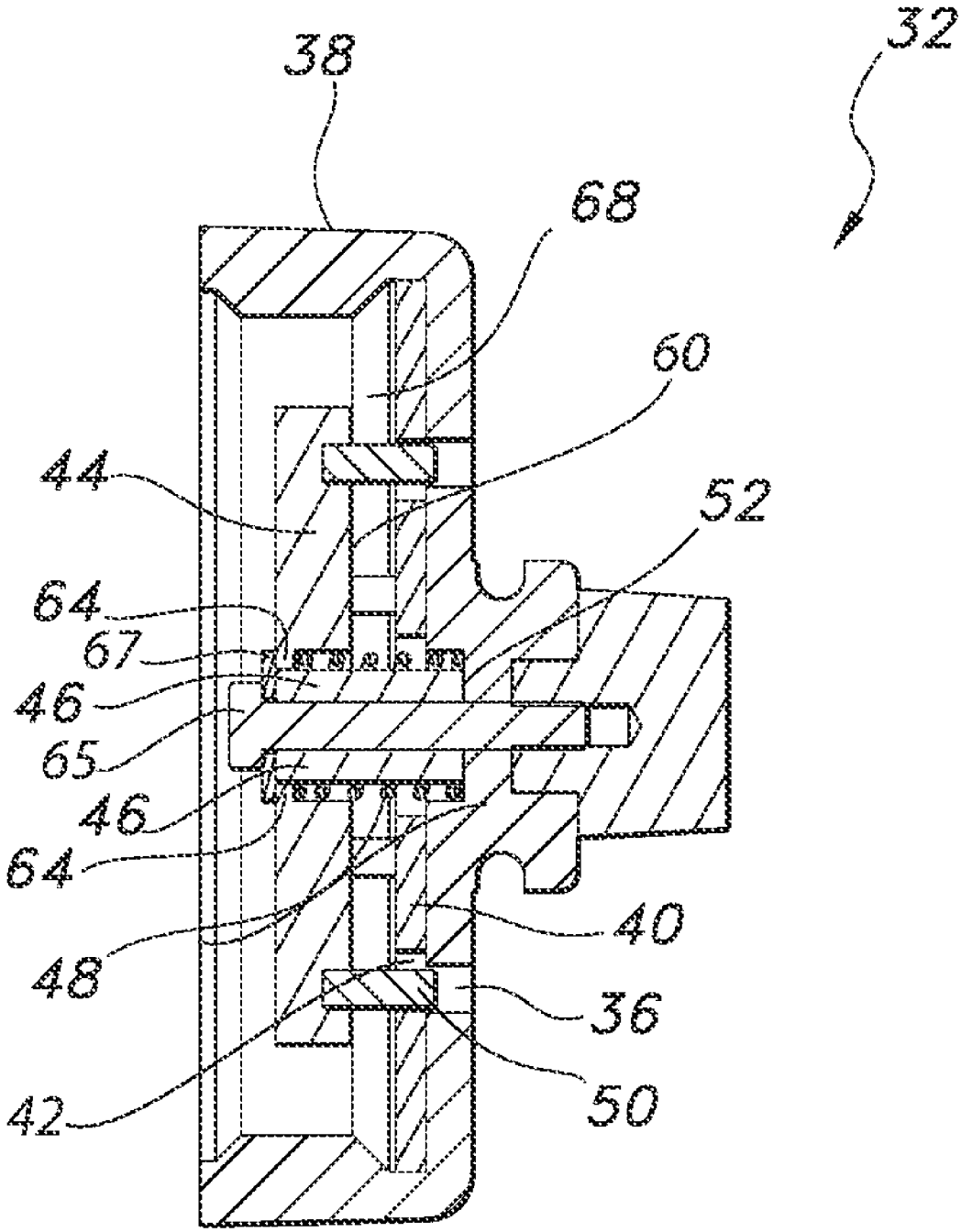
FIG. 11 shows a cross-sectional view of a vented steamer port cap assembly in a venting position according to one embodiment of the present invention.

FIG. 11 shows a cross-sectional view of vented steamer port cap assembly 32 in a venting position according to one embodiment of the present invention. The vented steamer port cap assembly 32 may be adapted to couple to a hydrant steamer port. The venting position may allow air and/or water to enter and/or exit the hydrant interior. In some embodiments, vented steamer port cap assembly 32 remains in the venting position until a primary hydrant valve is opened and water or other fluid traveling through the hydrant interior exerts a pressure on the vented steamer port cap assembly 32.

In the venting position, spring 48 creates a gap 68 between interior surface 60 and gasket 40 by pressing against lip 64. In the venting position, spring 48 is partially compressed by the coupling of screw 65 to steamer port cap 38. Screw 65 is also coupled to check valve 44 via a washer 67. Washer 67 is located adjacent to lip 64 and causes check valve 44 to exert a normal pressure on spring 48. In some embodiments, a normal pressure of ten pounds per square inch (psi) is applied to spring 48 into the venting position.

In the venting position, Pin 50 may be partially retracted relative to gasket aperture 42 and cap aperture 36. In some embodiments, pin 50 is fully retracted from gasket aperture 42 and cap aperture 36. Gap 68 allows air and/or water to enter and/or exit the hydrant interior between check valve 44 and steamer port cap 38.

Figure 12:
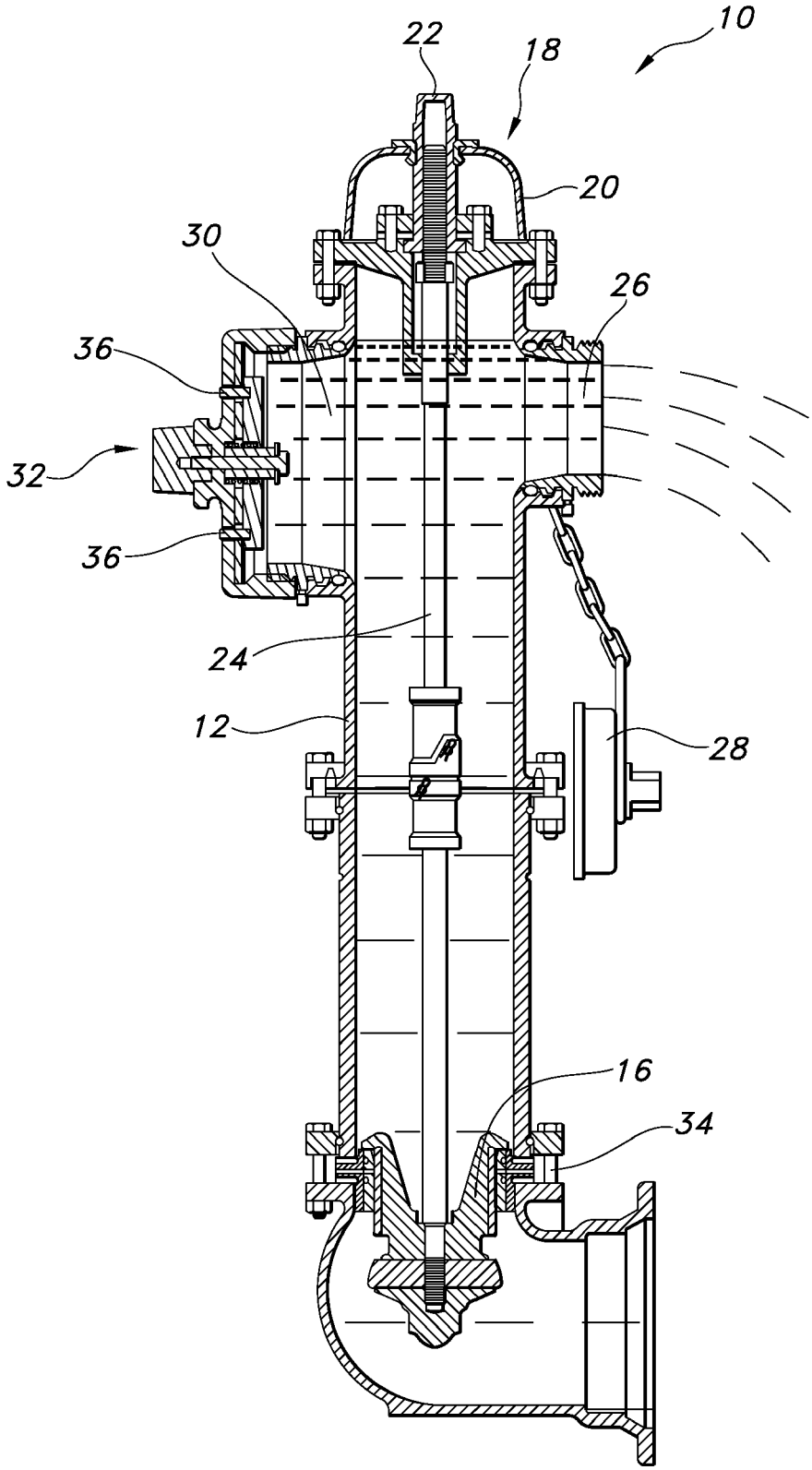
FIG. 12 shows a cross-sectional view of a hydrant with a vented steamer port cap assembly in a closed position according to one embodiment of the present invention.

FIG. 12 shows primary hydrant valve 16 in an open position, allowing water to flow through hydrant 10 and out nozzle 26. The force of the water flowing through hydrant 10 applies pressure to check valve 44. The check value 44 may compress spring 48 and contact gasket 40 to be positioned in a closed steamer port cap assembly position. In some embodiments, check valve 44 compresses spring 48 and contacts steamer port cap 38. In some embodiments, a force of eighteen pounds per square inch (psi) is needed to compress spring 48 into a closed position.

In some embodiments, pin 50 extends through gasket aperture 42 and cap aperture 36. The pin 50 may extend past the external surface of steamer port cap 38. In some embodiments, pin 50 may extend through gasket aperture 42 and at least partially through cap aperture 36 and not past the external surface of steamer port cap 38.

Figure 13:
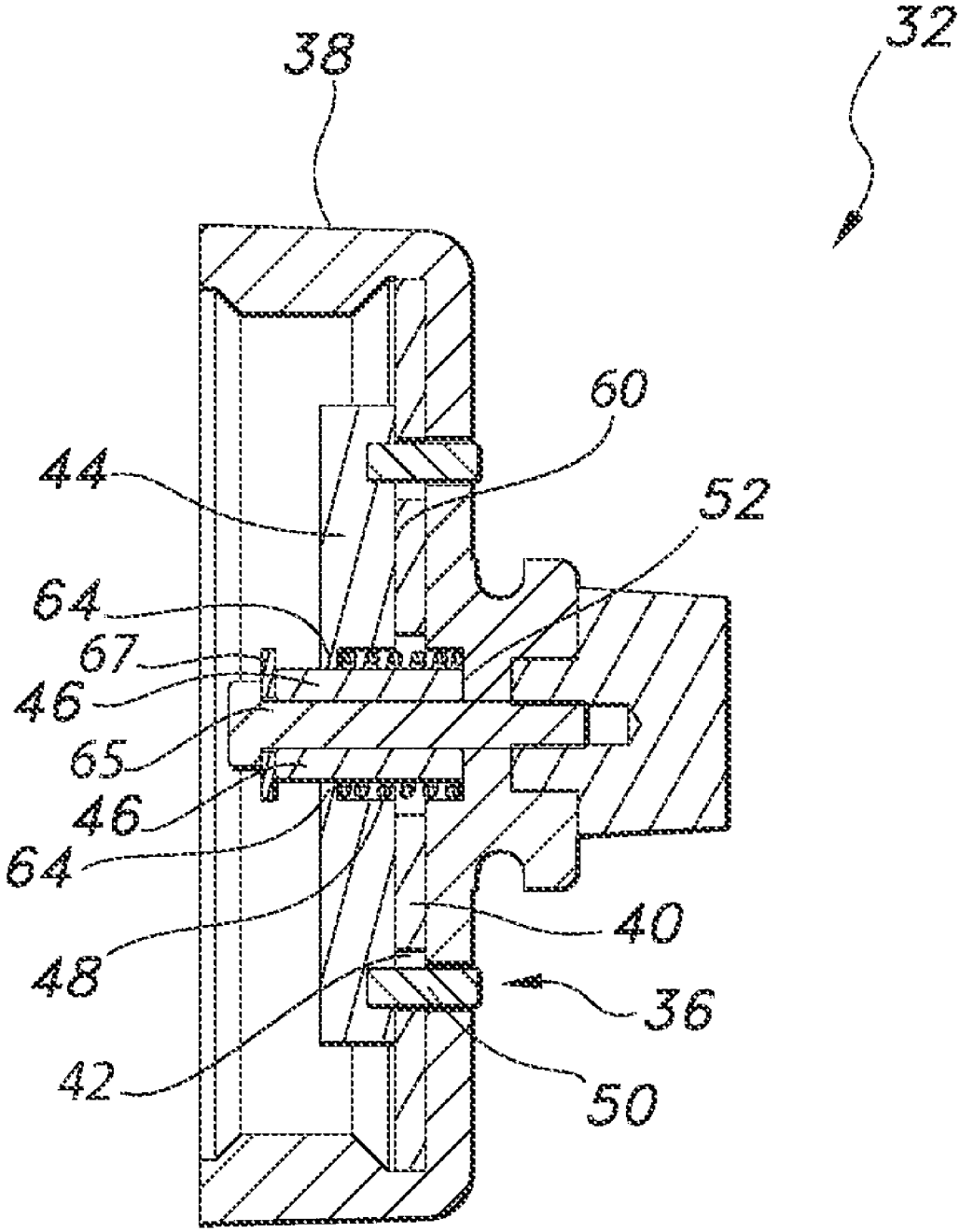
FIG. 13 shows a cross-sectional view of a vented steamer port cap assembly in a closed position according to one embodiment of the present invention.

FIG. 13 shows a cross-sectional view of vented steamer port cap assembly 32 in a closed position according to one embodiment of the present invention. The force of the water exiting hydrant 10 may cause interior surface 60 to contact gasket 40. When interior surface 60 contacts gasket 40, gap 68 closes and prevents water and air from entering or exiting the hydrant interior through cap aperture 36.

When water stops traveling through the hydrant interior, such as when the primary valve is closed, steamer port cap assembly 32 may return to an open venting position. For example, spring 48 may at least partially decompress and force check valve 44 into an open position to create gap 68.

Illustrative Secondary Hydrant Valve and Vented Steamer Port Cap Assembly

Figure 14:
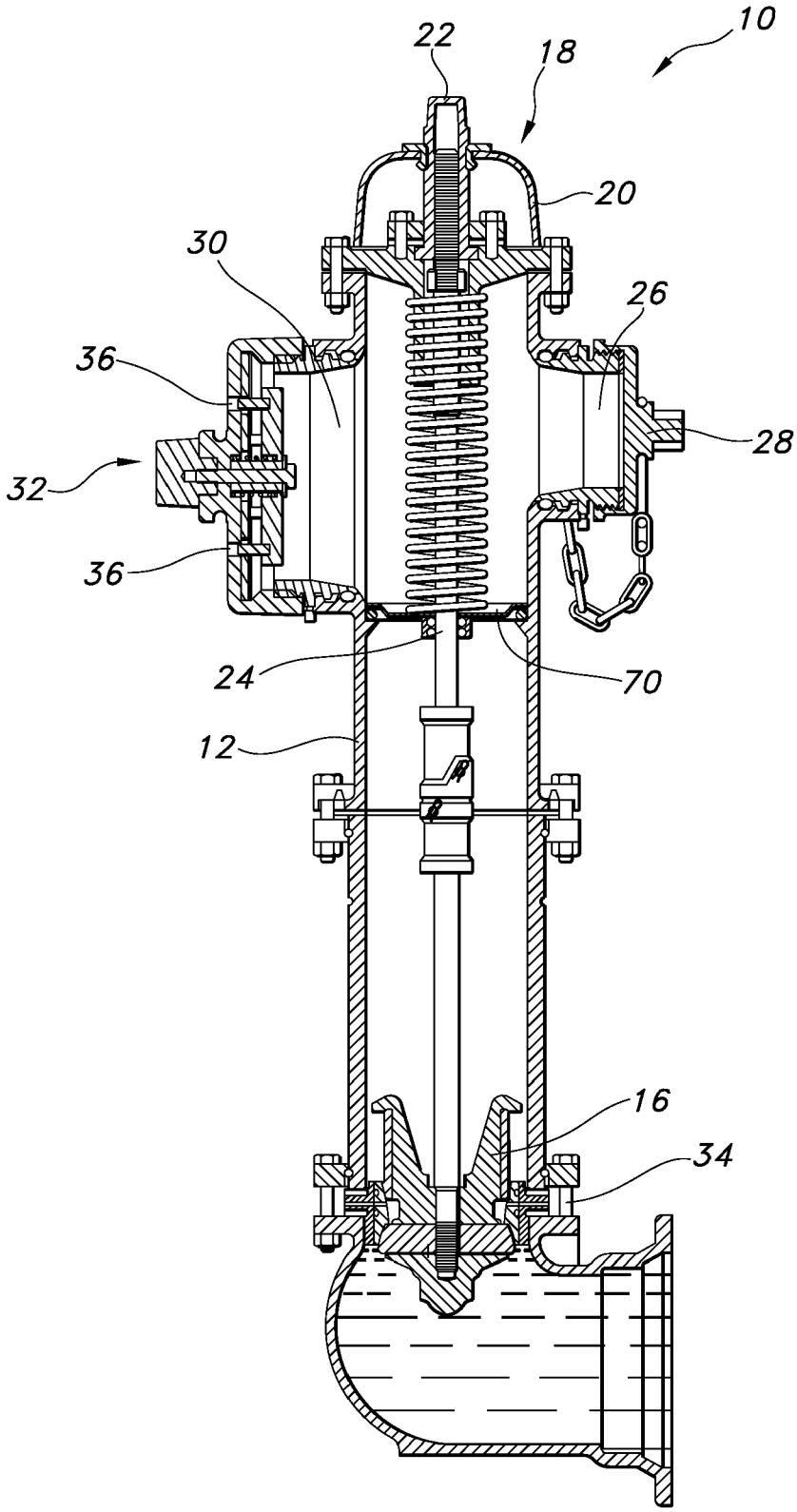
FIG. 14 shows a cross-sectional view of a fire hydrant with a secondary valve and a vented steamer port cap assembly in a venting position according to one embodiment of the present invention.

FIG. 14 shows another embodiment of hydrant 10, which includes a secondary hydrant valve 70. Secondary hydrant valve 70 may prevent or substantially prevent flow of water or other fluids by closing off a lower portion of barrel 12 to preclude or render more difficult introduction of toxins into the closed-off portions of barrel 12. Under some circumstances, secondary hydrant valve 70 may close before the water level inside barrel 12 is below the location of secondary hydrant valve 70, thus trapping water in the upper portion of barrel 12 above secondary hydrant valve 70. In those circumstances, vented steamer port cap assembly 32 may allow trapped water to exit the hydrant interior through cap aperture 36 while in the venting position.

In some embodiments, steamer port 30 and steamer port cap assembly 32 may be located at or below secondary hydrant valve 70. The pressure inside barrel 12 may not be equalized between the interior portions of barrel 12 above and below secondary hydrant valve 70. When the pressure between the two portions is not equalized, water may not drain out drain hole 34. Vented steamer port cap assembly 32 may equalize pressure inside barrel 12 above and below secondary hydrant valve 70 by allowing air to enter and/or exit the hydrant interior through cap aperture 36 while in the venting position.

Figure 15:
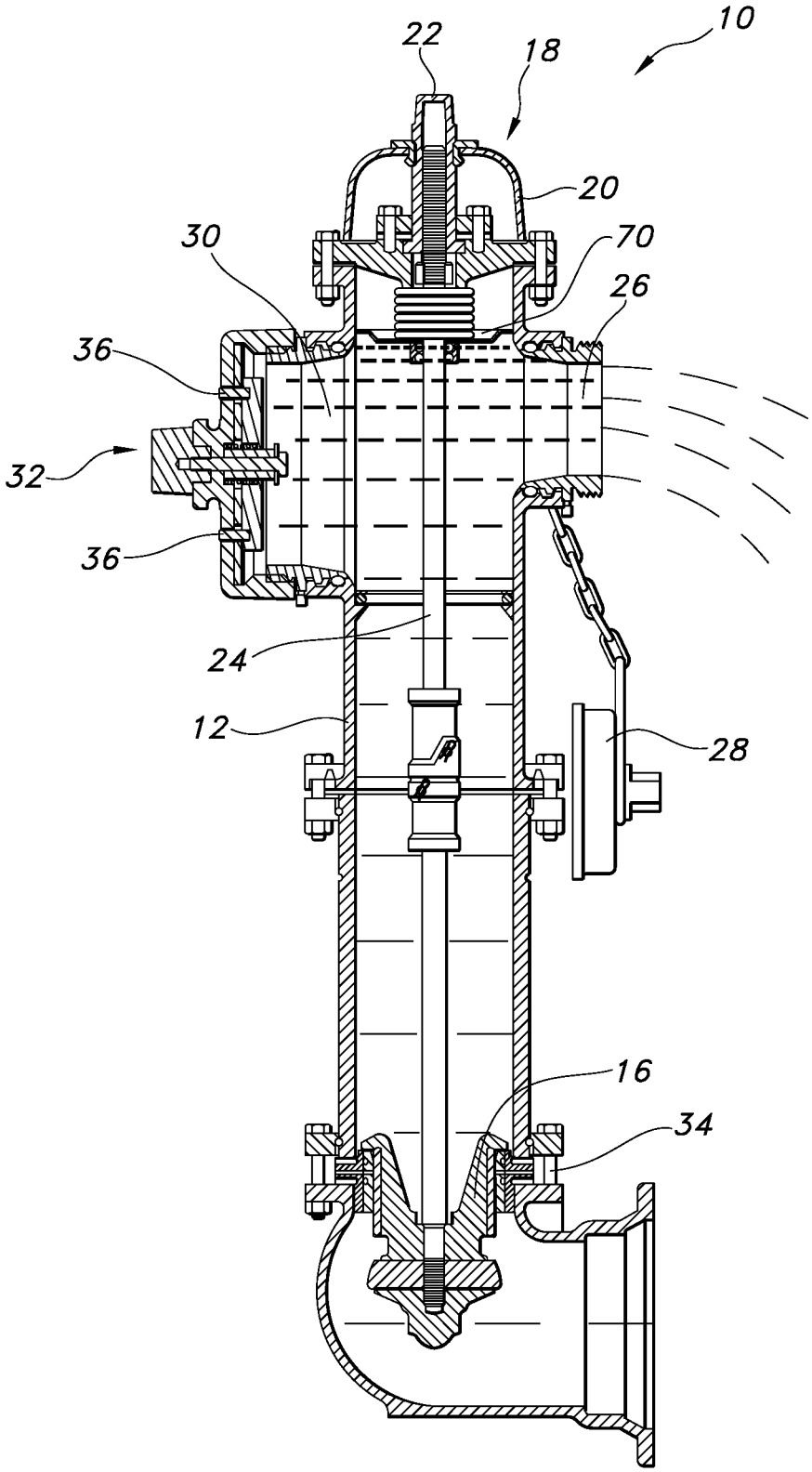
FIG. 15 shows a cross-sectional view of the hydrant of FIG. 14 with a vented steamer port cap assembly in the closed position.

FIG. 15 shows primary hydrant valve 16 and secondary hydrant valve 70 in the open position, allowing water to flow through hydrant 10 and out nozzle 26. When water is flowing through hydrant 10, vented steamer port cap assembly 32 may be placed in the closed position, preventing water and air from entering and exiting cap aperture 36 while hydrant 10 is in operation.

Illustrative Method of Making a Vented Steamer Port Cap Assembly

The following is an example of making a vented steamer port cap assembly according to one embodiment of the present invention. A non-vented steamer port cap is provided that is cylindrical in shape. At least one aperture may be bored or otherwise formed through the steamer port cap with a diameter of at least 0.315 inches. An indentation of approximately 0.75 inches in diameter may be created in the center of the interior surface of the vented steamer port cap. In the center of the indentation, a threaded indentation may be drilled at a diameter of approximately 0.315 inches.

The now-vented steamer port cap can include at least a 5.8 inch diameter interior opening. This opening may taper inward to create a cylindrical channel of approximately 4.5 inches in diameter, which may taper out again to create a niche of at least 5.94 inches in diameter. The niche may create a lip to hold a gasket snugly against the interior surface of the steamer port cap.

A gasket with a corresponding outer diameter of at least 5.94 inches may be provided. At least one aperture having a diameter of at least 0.400 inches may be bored or otherwise formed through the gasket. In addition, an aperture of approximately 1.2 inches may be created through the center of the gasket.

A check valve having at least a 3.5 inch outer diameter may be provided. An aperture can be drilled through the center of the check valve. The interior diameter of the aperture may be approximately 1.0 inches but narrows to create a lip surrounding an approximate 0.75 inch diameter exit aperture. At least one indentation of at least 0.25 inches in diameter may be bored or otherwise formed on the interior surface of the check valve. At least one pin having a diameter of at least 0.25 inches and a length of at least 1.0 inches may be coupled to the indentation so that the pin extends outwardly from the interior surface of the check valve.

The gasket may be press-fit into the niche adjacent to the interior surface of the steamer port cap. A shaft may be inserted through the center aperture in the gasket and attached to the indentation in the center of the steamer port cap. A spring may be placed over the shaft so that the coils of the spring surround the shaft. The check valve may be inserted over the shaft, so that the shaft extends through the center aperture in the check valve, while the spring is compressed against the lip. The pin may be aligned to extend through the apertures created in the gasket and the steamer port cap. A screw may be inserted through the center of the shaft, which connects to the threaded indentation in the steamer port cap.

Illustrative Methods for Retrofitting a Fire Hydrant with a Vented Steamer Port Cap Assembly New hydrants may be manufactured having vented steamer port cap assemblies according to various embodiments of the present invention. Existing hydrants may be retrofitted to include a vented steamer port cap assembly. A hydrant may be retrofitted with a vented steamer port cap assembly by first removing the existing steamer port cap currently installed on the hydrant. The existing steamer port cap may be attached to the hydrant by a chain or other securing device. The steamer port cap may be removed from the securing device to detach it from the hydrant. A vented steamer port cap assembly may be provided manufactured in accordance with various embodiments of the present invention. The vented steamer port cap assembly may include a steamer port cap having at least one aperture, a check valve and a spring between the check valve and steamer port cap. The spring may be adapted to create a gap between the check valve and steamer port cap in a venting position and compress due to pressure exerted on the check valve by water traveling through the hydrant in a closed position. The vented steamer port cap assembly may be attached to the securing device. The vented steamer port cap assembly may be coupled to the steamer port and secured by rotating the threaded portion of the vented steamer port cap assembly over the threaded portion of the steamer port.

The foregoing description of the embodiments of the invention has been presented only for the purpose of illustration and description and is not intended to be exhaustive or to limit the invention to the precise forms described. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope.

What is claimed is:

1. A vented steamer port cap assembly comprising:

a steamer port cap comprising at least one cap aperture and a shaft, the steamer port cap being adapted to couple to a fire hydrant steamer port;

a check valve coupled to the shaft; and a spring adapted to provide a gap between the check valve and the steamer port cap until pressure is applied to the check valve.

2. The vented steamer port cap assembly of claim 1, wherein a gasket is coupled to an interior surface of the steamer port cap, wherein the gasket comprises at least one gasket aperture substantially aligned with the at least one cap aperture.

3. The vented steamer port cap assembly of claim 2, wherein the at least one cap aperture comprises six cap apertures and the at least one gasket aperture comprises six gasket apertures; and wherein each cap aperture is substantially aligned with a gasket aperture.

4. The vented steamer port cap assembly of claim 1, wherein at least one pin is located on a surface of the check valve, the at least one pin extending outwardly through the at least one cap aperture.

5. The vented steamer port cap assembly of claim 1, wherein the check valve closes the at least one cap aperture when pressure is applied to the check valve.

6. The vented steamer port cap assembly of claim 5, wherein the pressure applied to the check valve comprises eighteen pounds per square inch.

7. The vented steamer port cap assembly of claim 1, wherein the gap is sized to allow air and water to enter or exit a hydrant interior.

8. The vented steamer port cap assembly of claim 1, wherein the at least one cap aperture comprises a plurality of cap apertures.

9. The vented steamer port cap assembly of claim 8, wherein a plurality of pins are located on a surface of the check valve, each of the plurality of pins being adapted to extend through a cap aperture.

10. A combination of a fire hydrant and a steamer port, the steamer port comprising:

a vented steamer port cap assembly coupled to the steamer port, the vented steamer port cap assembly comprising:

a steamer port cap comprising at least one cap aperture and a shaft;

a check valve coupled to the shaft; and a spring adapted to provide a gap between the check valve and the steamer port cap until pressure is applied to the check valve.

11. The combination of a fire hydrant and steamer port of claim 10, wherein a gasket is coupled to an interior surface of the steamer port cap, wherein the gasket comprises at least one gasket aperture substantially aligned with the at least one cap aperture.

12. The combination of a fire hydrant and a steamer port of claim 10, wherein at least one pin is located on a surface of the check valve, the at least one pin extending outwardly through the at least one cap aperture.

13. A fire hydrant comprising:

a barrel adapted to communicate at least indirectly with a water conduit, the barrel comprising an interior cavity;

a steamer port for providing access to the barrel interior;

a vented steamer port cap assembly coupled to the steamer port, the vented steamer port cap assembly comprising:

a steamer port cap comprising at least one cap aperture and a shaft;

a check valve coupled to the shaft; and a spring adapted to provide a gap between the check valve and the steamer port cap until pressure is applied to the check valve.

14. The fire hydrant of claim 13, wherein a gasket is coupled to an interior surface of the steamer port cap, wherein the gasket comprises at least one gasket aperture substantially aligned with the at least one cap aperture.

15. The fire hydrant of claim 13, wherein at least one pin is located on a surface of the check valve, the at least one pin extending outwardly through the at least one cap aperture.

16. The fire hydrant of claim 13, wherein a primary hydrant valve is located at the base of the hydrant adapted to controllably restrict communication between the barrel and the water conduit.

17. The fire hydrant of claim 13, wherein a secondary hydrant valve is located between a primary hydrant valve and an upper portion of the barrel for controllably allowing liquid to flow through the barrel.

18. The fire hydrant of claim 13, wherein the vented steamer port cap assembly drains excess water from the barrel.

19. The fire hydrant of claim 13, wherein the vented steamer port cap assembly allows air to circulate through the barrel.

20. A method of retrofitting a fire hydrant with a vented steamer port cap assembly comprising:

(a) selecting a hydrant, the hydrant comprising a hydrant body, a steamer port, and a steamer port cap:

(b) detaching the steamer port cap from the steamer port;

(c) providing a vented steamer port cap assembly, the vented steamer port cap assembly comprising:

(1) a steamer port cap comprising at least one cap aperture and a shaft;

(2) a check valve coupled to the shaft; and (3) a spring adapted to provide a gap between the check valve and the steamer port cap until pressure is applied to the check valve;

(c) placing the vented steamer port cap assembly over the steamer port; and (d) tightening the vented steamer port cap assembly over a threaded portion of the steamer port.

21. The method of claim 20, wherein detaching the steamer port cap comprises:

(a) loosening the steamer port cap from the threaded portion of the steamer port; and (b) detaching the steamer port cap from a securing device.

22. The method of claim 20, wherein a gasket is coupled to an interior surface of the steamer port cap, wherein the gasket comprises at least one gasket aperture substantially aligned with the at least one cap aperture.

23. The method of claim 20, wherein at least one pin is located on a surface of the check valve, the at least one pin extending outwardly through the at least one cap aperture.

* * * * *